US007244113B2

(12) United States Patent
Liepert et al.

(10) Patent No.: US 7,244,113 B2
(45) Date of Patent: Jul. 17, 2007

(54) SCROLL PUMP WITH CONTROLLED AXIAL THERMAL EXPANSION

(75) Inventors: Anthony G. Liepert, Lincoln, MA (US); Jeffrey C. Warren, Westford, MA (US); Robert M. Curry, Jr., Arlington, MA (US)

(73) Assignee: Varian, Inc., Palo Alto, CA (US)

( * ) Notice: Subject to any disclaimer, the term of this patent is extended or adjusted under 35 U.S.C. 154(b) by 195 days.

(21) Appl. No.: 10/960,673

(22) Filed: Oct. 7, 2004

(65) Prior Publication Data

US 2006/0078450 A1 Apr. 13, 2006

(51) Int. Cl.
*F01C 1/02* (2006.01)

(52) U.S. Cl. ..... 418/55.1; 418/55.3; 415/216.1

(58) Field of Classification Search ..... 418/55.1, 418/55.3; 415/216.1
See application file for complete search history.

(56) References Cited

U.S. PATENT DOCUMENTS

| | | | | |
|---|---|---|---|---|
| 3,801,226 | A * | 4/1974 | Bevan et al. | 416/241 R |
| 4,382,754 | A | 5/1983 | Shaffer et al. | |
| 4,490,099 | A | 12/1984 | Terauchi et al. | |
| 4,737,073 | A * | 4/1988 | Grayden | 415/216.1 |
| 4,773,835 | A | 9/1988 | Machida et al. | |
| 5,616,015 | A | 4/1997 | Liepert | |
| 5,755,564 | A | 5/1998 | Machida et al. | |
| 6,062,833 | A * | 5/2000 | Holzapfel et al. | 418/55.3 |
| 6,290,477 | B1 * | 9/2001 | Gigon | 418/55.2 |
| 6,336,797 | B1 * | 1/2002 | Kazakis et al. | 418/55.1 |
| 6,499,967 | B2 * | 12/2002 | Hansen | 417/365 |
| 6,579,076 | B2 * | 6/2003 | Narney et al. | 417/365 |
| 2005/0042118 | A1 * | 2/2005 | Sekiguchi et al. | 417/423.4 |

FOREIGN PATENT DOCUMENTS

| | | |
|---|---|---|
| GB | 987681 A | 3/1965 |
| JP | 07 217553 | 8/1995 |
| JP | 2002 070761 | 3/2002 |

* cited by examiner

*Primary Examiner*—Hoang Nguyen
(74) *Attorney, Agent, or Firm*—Bella Fishman

(57) ABSTRACT

Vacuum pumping apparatus includes a pump frame, a stationary scroll element secured to the pump frame, the stationary scroll element including a stationary scroll blade, an orbiting scroll element including an orbiting scroll blade intermeshed with the stationary scroll blade, a motor secured to the pump frame, and a crankshaft coupled between the motor and the orbiting scroll element for producing orbiting movement of the orbiting scroll blade relative to the stationary scroll blade when the motor is energized. The crankshaft includes a first component having a first coefficient of thermal expansion and a second component having a second coefficient of thermal expansion.

18 Claims, 2 Drawing Sheets

SCROLL PUMP WITH CONTROLLED AXIAL THERMAL EXPANSION

FIELD OF THE INVENTION

This invention relates to scroll-type pumps and, more particularly, to devices and methods for control of axial thermal expansion in scroll-type pumps.

BACKGROUND OF THE INVENTION

Scroll devices are well-known in the field of vacuum pumps and compressors. In a scroll device, a movable spiral blade orbits with respect to a fixed spiral blade. The movable spiral blade is connected to an eccentric drive mechanism. The configuration of the scroll blades and their relative motion traps one or more volumes or "pockets" of a gas between the blades and moves the gas through the device. Most applications apply rotary power to pump the gas through the device. Oil-lubricated scroll devices are widely used as refrigerant compressors. Other applications include expanders, which operate in reverse from a compressor, and vacuum pumps. Scroll pumps have not been widely adopted for use as vacuum pumps, mainly because the cost of manufacturing a scroll pump is significantly higher than a comparably sized, oil-lubricated vane pump. Dry scroll pumps have been used in applications where oil contamination is unacceptable. A high displacement rate scroll pump is described in U.S. Pat. No. 5,616,015, issued Apr. 1, 1997 to Liepert.

A scroll pump includes stationary and orbiting scroll elements, and a drive mechanism. The stationary and orbiting scroll elements each include a scroll plate and a spiral scroll blade extending from the scroll plate. The scroll blades are intermeshed together to define interblade pockets. The drive mechanism produces orbiting motion of the orbiting scroll element relative to the stationary scroll element so as to cause the interblade pockets to move toward the pump outlet.

Careful design of the scroll pump is required to provide the close spacing needed for an acceptable compression ratio and yet avoid undesired contact between the scroll blades during operation. Thermal expansion causes component dimensions to vary, both axially and radially. Thus, thermal performance must be considered. Tip seals are typically utilized between the tip of each scroll blade and the adjacent scroll plate. The tip seals may be resilient to accommodate dimensional variations resulting from thermal expansion. The thermal performance of the scroll pump is complicated by the fact that some elements, such as the motor and the crankshaft, can experience significant heating during operation, while other components, such as the external housing, may experience little heating. Further, the scroll pump may be required to operate over a range of temperatures.

U.S. Pat. No. 4,382,754, issued May 10, 1983 to Shaffer et al., discloses a scroll-type apparatus wherein the scroll elements are formed with varying thicknesses along the lengths thereof to accommodate a difference in thermal expansion between the innermost and outermost zones of the apparatus. U.S. Pat. No. 4,490,099, issued Dec. 25, 1984 to Terauchi et al., discloses a scroll-type apparatus wherein the scroll blades are thicker near the center to avoid being affected by dimensional errors of the scroll blades or by thermal expansion. U.S. Pat. No. 4,773,835, issued Sep. 27, 1988 to Machida et al., discloses a scroll-type pump wherein a curve of the scroll blade is offset inwardly or outwardly relative to a set curve so as to prevent formation of a gap between the blades due to thermal expansion of the scroll blades. These patents are directed to the problem of radial expansion but do not address the issue of axial expansion in a scroll-type pump.

Accordingly, there is a need for improved scroll-type pumping apparatus and methods.

SUMMARY OF THE INVENTION

According to a first aspect of the invention, vacuum pumping apparatus is provided. The vacuum pumping apparatus comprises a scroll set having an inlet and an outlet, a motor and a crankshaft. The scroll set comprises a stationary scroll element including a stationary scroll blade and an orbiting scroll element including an orbiting scroll blade. The stationary and orbiting scroll blades are intermeshed together to define one or more interblade pockets. The crankshaft is operatively coupled between the motor and the orbiting scroll element for producing orbiting movement of the orbiting scroll blade relative to the stationary scroll blade when the motor is energized. The crankshaft comprises a first component of a first material rigidly joined to a second component of a second material. The first and second materials have different coefficients of thermal expansion.

The first and second materials may be metals. In some embodiments, the first material comprises steel and the second material comprises an iron-nickel alloy having a low coefficient of thermal expansion. The dimensions and materials of the first and second components of the crankshaft may be selected to provide a desired thermal expansion.

According to a second aspect of the invention, vacuum pumping apparatus is provided. The vacuum pumping apparatus comprises a pump frame, a stationary scroll element secured to the pump frame, the stationary scroll element including a stationary scroll blade, an orbiting scroll element including an orbiting scroll blade intermeshed with the stationary scroll blade, a motor secured to the pump frame, and a crankshaft coupled between the motor and the orbiting scroll element for producing orbiting movement of the orbiting scroll blade relative to the stationary scroll blade when the motor is energized. The crankshaft comprises a first component having a first coefficient of thermal expansion and a second component having a second coefficient of thermal expansion.

According to a third aspect of the invention, a method is provided for operating vacuum pumping apparatus of the type comprising a first scroll element and a second scroll element. The method comprises producing orbiting motion of the second scroll element relative to the first scroll element with a motor and an eccentric crankshaft. The eccentric crankshaft comprises a first component having a first coefficient of thermal expansion rigidly joined to a second component having a second coefficient of thermal expansion.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
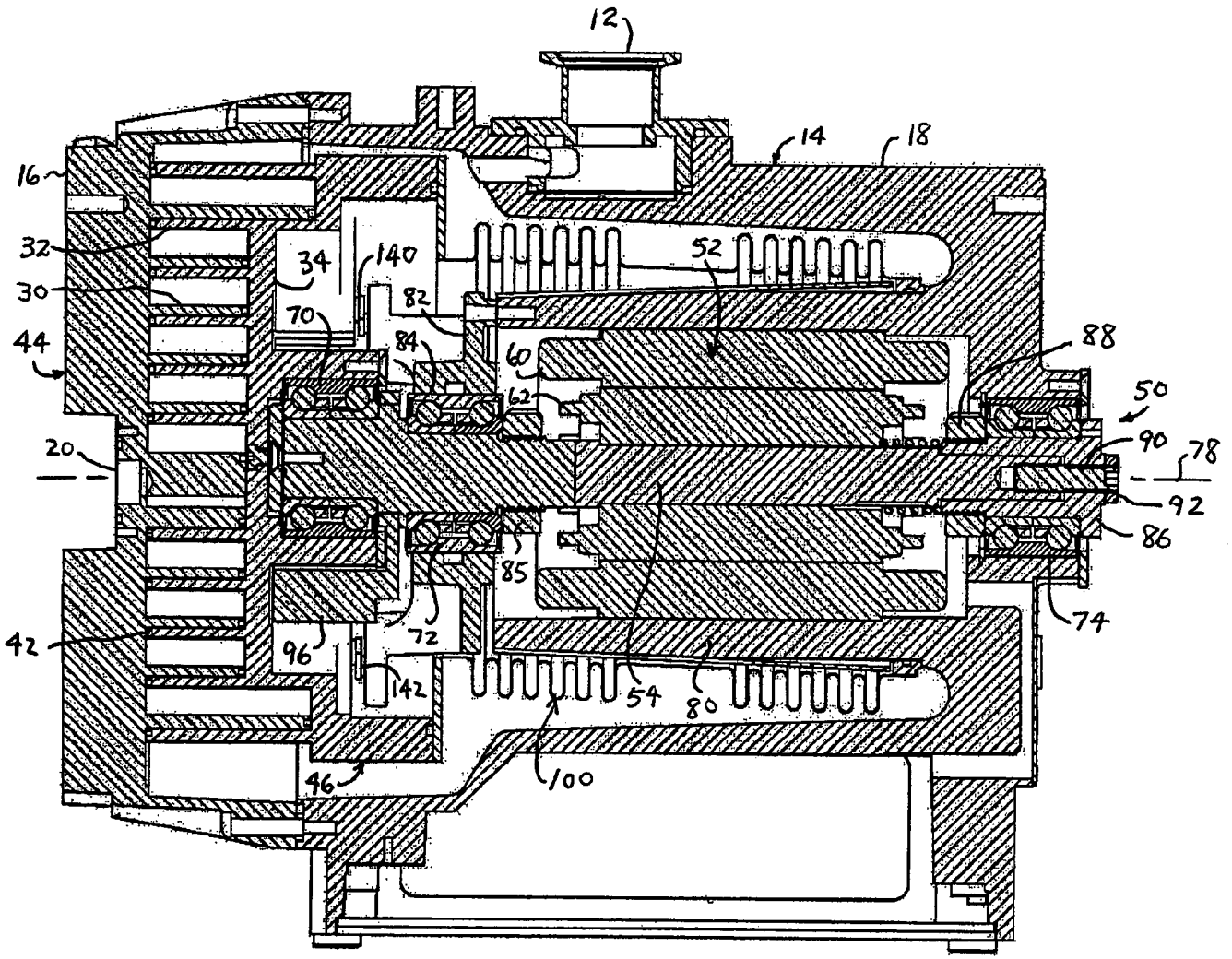
FIG. 1 is a schematic, cross-sectional side view of a scroll pump in accordance with an embodiment of the invention.
Figure 2:
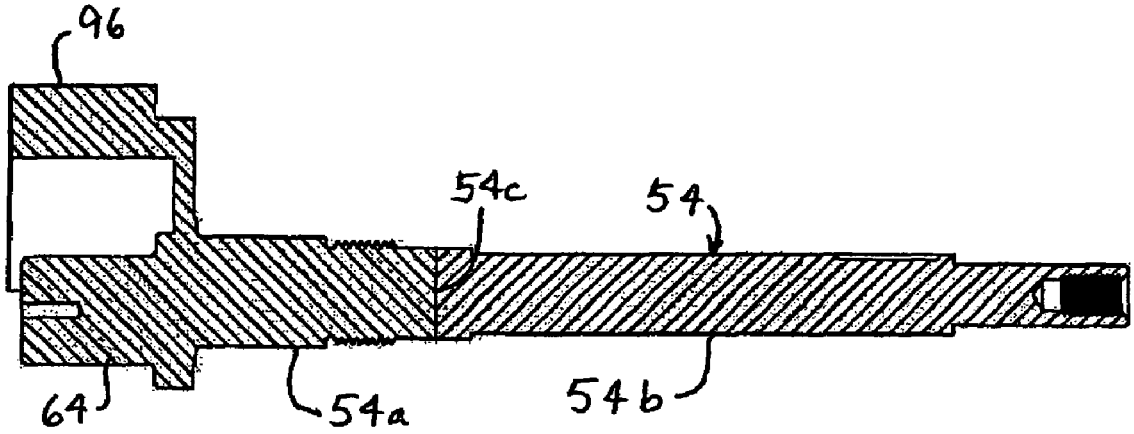
FIG. 2 is a cross-sectional view of the crankshaft in the scroll pump of FIG. 1.

A scroll pump in accordance with an embodiment of the invention is shown in FIG. 1. A gas, typically air, is evacuated from a vacuum chamber or other equipment (not shown) connected to an inlet 12 of the pump. A pump housing 14 includes a stationary scroll plate 16 secured to a frame 18. The pump further includes an outlet 20 for exhaust of the gas being pumped.

The scroll pump includes a set of intermeshed, spiral-shaped scroll blades. A scroll set includes a stationary scroll blade 30 extending from stationary scroll plate 16 and an orbiting scroll blade 32 extending from an orbiting scroll plate 34. Scroll blades 30 and 32 are preferably formed integrally with scroll plates 16 and 34, respectively, to facilitate thermal transfer and to increase the mechanical rigidity and durability of the pump. Scroll blade 30 and scroll plate 16 constitute a stationary scroll element 44, and scroll blade 32 and scroll plate 34 constitute an orbiting scroll element 46. Scroll blades 30 and 32 extend axially toward each other and are intermeshed to form interblade pockets 40. Tip seals 42 located in grooves at the tips of the scroll blades provide sealing between the scroll blades. Orbiting motion of scroll blade 32 relative to scroll blade 30 produces a scroll-type pumping action of the gas entering the interblade pockets between the scroll blades.

A drive mechanism 50 for the scroll pump includes a motor 52 coupled through a crankshaft 54 to orbiting scroll plate 34. Motor 52 includes a stator 60 and a rotor 62, which is affixed to crankshaft 54. An end 64 of crankshaft has an eccentric configuration with respect to the main part of crankshaft 54 and is mounted to orbiting scroll plate 34 through an orbiting plate bearing 70. Crankshaft 54 is mounted to the pump housing through main bearings 72 and 74 as described below. When motor 52 is energized, crankshaft 54 rotates in main bearings 72 and 74 about an axis 78. The eccentric configuration of crankshaft end 64 produces orbiting motion of scroll blade 32 relative to scroll blade 30, thereby pumping gas from inlet 12 to outlet 20.

The frame 18 includes a re-entrant center hub 80 which extends inwardly toward scroll blades 30 and 32 and which defines a cavity for receiving motor 52 and crankshaft 54. A ring 82 mounted to center hub 80 defines a bore 84 for mounting main bearing 72. A nut 85 threaded on crankshaft 54 clamps the inner races of bearing 72 together. Bearing 72 can slide axially in bore 84 of ring 82. At the rear of the scroll pump, the inner race of bearing 74 is secured between a bearing sleeve 86 and a nut 88 threaded on bearing sleeve 86. The outer race of bearing 74 is secured to frame 18. A stud 90 is threaded into the rear end of crankshaft 54 and is fixed in position with an adhesive. Bearing sleeve 86 is threaded on stud 90. The axial position of orbiting scroll blade 32 may be adjusted by rotating bearing sleeve 86 with respect to stud 90. When orbiting scroll blade 32 is in the desired axial position, a jam nut 92 locks sleeve 86 and stud 90 together.

A counterweight assembly connected to crankshaft 54 provides balanced operation of the vacuum pump when motor 52 is energized. In some embodiments, the counterweight assembly includes a single counterweight 96 connected to crankshaft 54. In other embodiments, the counterweight assembly includes at least two counterweights connected to crankshaft 54.

The scroll pump further includes a bellows assembly 100 coupled between a first stationary component of the vacuum and the orbiting scroll plate 34 so as to isolate a first volume inside bellows assembly 100 and a second volume outside bellows assembly 100. One end of bellows assembly 100 is free to rotate during motion of the orbiting scroll blade 32 relative to the stationary scroll blade 30. As a result, the bellows assembly 100 does not synchronize the scroll blades and is not subjected to significant torsional stress during operation.

The scroll pump further includes a synchronization mechanism coupled between the orbiting scroll plate 34 and a stationary component of the vacuum pump. In the embodiment of FIG. 1, the synchronization mechanism includes three sets of synchronization cranks, each coupled between orbiting scroll plate 34 and a stationary component of the vacuum pump. In FIG. 1, synchronization cranks 140 and 142 are shown. Synchronization cranks 140 and 142 and one additional synchronization crank (not shown) are equally spaced from axis 78 and are equally spaced with respect to each other. Other synchronization mechanisms may be utilized within the scope of the present invention.

As discussed above, scroll pumps require close spacing between stationary scroll blade 30 and orbiting scroll blade 32 during orbiting motion of scroll blade 32. The close spacing is needed to ensure an acceptable compression ratio. The spacing must be maintained over a range of operating temperatures. If the spacing becomes too large, performance suffers. If the scroll blades come into contact, the scroll pump may cease operation and may be damaged. Furthermore, different parts of the scroll pump may operate at different temperatures. For example, crankshaft 54 may operate at a relatively high temperature in comparison with the outer surface of pump housing 14. Components which operate at different temperatures and which may be fabricated of different materials experience different thermal expansions.

One key parameter of the scroll pump is the axial spacing between stationary scroll blade 30 and orbiting scroll blade 32. The axial spacing may typically be in a range of about 0.005 to 0.010 inch. The axial spacing is affected by thermal expansion of components of the scroll pump. Uncontrolled axial expansion can potentially cause contact between scroll blades 30 and 32 or can cause tip seals 42 to lose contact with the adjacent sealing surface, thereby degrading pump performance.

According to a feature of the invention, crankshaft 54 includes a first component 54*a* rigidly joined to a second component 54*b*. First component 54*a* is fabricated of a first material having a first coefficient of thermal expansion, and second component 54*b* is fabricated of a second material having a second coefficient of thermal expansion. The materials and lengths of components 54*a* and 54*b* are selected to provide a desired thermal performance during operation of the scroll pump. First component 54*a* and second component 54*b* are typically metals and are rigidly joined together at a joint 54*c* to form crankshaft 54. In one embodiment, components 54*a* and 54*b* are secured together at joint 54*c* by friction welding. In other embodiments, components 54*a* and 54*b* are mechanically joined, such as by swaging or threading, to form crankshaft 54.

In one embodiment, first component 54*a* is fabricated of steel and second component 54*b* is fabricated of an iron-nickel alloy having a very low coefficient of thermal expansion, known under the trade name INVAR. Other suitable materials include an iron-nickel alloy known under the trade name Iconel 617. The axial lengths of components 54*a* and 54*b*, as measured along axis 78, are selected to provide a desired axial thermal expansion during operation of the scroll pump. In one embodiment, the axial length of component 54*b* having a low coefficient of thermal expansion is about two-thirds of the total length of crankshaft 54. It will be understood that different materials and different relative lengths can be utilized within the scope of the invention to achieve a desired axial expansion during operation.

To control the axial thermal expansion of crankshaft 54, one of the components of the crankshaft is constructed of a material with a significantly different coefficient of thermal expansion from the other. The lengths of the two components are then adjusted accordingly to precisely control the axial position of the orbiting scroll element relative to the stationary scroll element when thermal equilibrium is reached.

The use of an axial expansion controlled crankshaft enables precise control over the axial gap between the stationary and orbiting scroll blades. This can contribute to a thermally neutral scroll pump design, with respect to axial gap, allowing the use of solid tip seals and eliminating the requirement for a spring-energized seal. The use of an axial expansion controlled crankshaft enables precise control over the axial gap between the stationary and orbiting scroll elements without significant changes to the overall design. The lengths of the two components of the crankshaft can be adjusted to precisely control axial positioning without changing the overall design or materials. The use of a two-component design allows more economic usage of potentially expensive materials. Many low coefficient of thermal expansion materials are expensive. The two-component design permits use of a minimal amount of the more expensive material.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. Vacuum pumping apparatus comprising:

a scroll set having an inlet and an outlet, said scroll set comprising a stationary scroll element including a stationary scroll blade and an orbiting scroll element including an orbiting scroll blade, wherein said stationary and orbiting scroll blades are intermeshed together defining one or more interblade pockets;

a motor; and a crankshaft operatively coupled between the motor and the orbiting scroll element, which produces orbiting movement of said orbiting scroll blade relative to said stationary scroll blade when said motor is energized, said crankshaft comprising a first component of a first material rigidly joined to a second component of a second material, wherein the first component has a first coefficient of thermal expansion and the second component has a second coefficient of thermal expansion that is significantly different from the first coefficient of thermal expansion, and wherein the first and second components have relative axial lengths that provide controlled axial expansion and establish a small, non-contacting gap between the orbiting scroll element and the stationary scroll element during operation of the vacuum pumping apparatus.

2. Vacuum pumping apparatus as defined in claim 1, wherein said first and second materials are metals.

3. Vacuum pumping apparatus as defined in claim 1, wherein said first material comprises steel and said second material comprises an iron-nickel alloy having a low coefficient of thermal expansion.

4. Vacuum pumping apparatus as defined in claim 2, wherein the first component is friction welded to the second component.

5. Vacuum pumping apparatus as defined in claim 1, wherein the first component is mechanically affixed to the second component.

6. Vacuum pumping apparatus as defined in claim 1, wherein the first component is swaged to the second component.

7. Vacuum pumping apparatus as defined in claim 1, wherein the first component is threaded to the second component.

8. Vacuum pumping apparatus as defined in claim 1, further comprising a pump frame, wherein said motor and said stationary scroll element are secured to the pump frame.

9. Vacuum pumping apparatus as defined in claim 8, wherein said crankshaft is rotatably secured to the pump frame at one end.

10. Vacuum pumping apparatus as defined in claim 1, wherein dimensions and materials of the first and second components of the crankshaft are selected to provide a desired axial thermal expansion.

11. Vacuum pumping apparatus comprising:

a pump frame;

a stationary scroll element secured to the pump frame, the stationary scroll element including a stationary scroll blade;

an orbiting scroll element including an orbiting scroll blade intermeshed with said stationary scroll blade;

a motor secured to the pump frame; and a crankshaft coupled between the motor and the orbiting scroll element producing orbiting movement of said orbiting scroll blade relative to said stationary scroll blade when said motor is energized, said crankshaft comprising a first component having a first coefficient of thermal expansion and a second component having a second coefficient of thermal expansion that is significantly different from the first coefficient of thermal expansion, and wherein the first and second components have relative axial lengths that provide controlled axial expansion and establish a small, non-contacting gap between the orbiting scroll element and the stationary scroll element during operation of the vacuum pumping apparatus.

12. Vacuum pumping apparatus as defined in claim 11, wherein the first component comprises steel and the second component comprises an iron-nickel alloy having a low coefficient of thermal expansion.

13. Vacuum pumping apparatus as defined in claim 11, wherein said first and second components are fabricated of metals.

14. Vacuum pumping apparatus as defined in claim 11, wherein the first component is friction welded to the second component.

15. Vacuum pumping apparatus as defined in claim 11, wherein the first component is mechanically affixed to the second component.

16. A method for operating vacuum pumping apparatus of the type comprising a first scroll element and a second scroll element, comprising:

producing orbiting motion of said second scroll element relative to said first scroll element with a motor and an eccentric crankshaft, said eccentric crankshaft comprising a first component of a first material having a first coefficient of thermal expansion rigidly joined to a second component of a second material having a second coefficient of thermal expansion that is significantly different from the first coefficient of thermal expansion, and wherein the first and second components have relative axial lengths that provide controlled axial expansion and establish a small, non-contacting gap between the orbiting scroll element and the stationary scroll element during operation of the vacuum pumping apparatus.

17. A method as defined in claim 16, wherein the first component comprises steel and the second component comprises an iron-nickel alloy having a low coefficient of thermal expansion.

18. A method as defined in claim 16, further comprising selecting dimensions and materials of the first and second components of the crankshaft to provide a desired axial thermal expansion.

* * * * *